US010057692B2

(12) United States Patent
Künzle et al.

(10) Patent No.: US 10,057,692 B2
(45) Date of Patent: Aug. 21, 2018

(54) HEARING DEVICE COMPRISING AN IMPROVED FEEDBACK CANCELLATION SYSTEM

(71) Applicants: Oticon A/S, Smørum (DK); Bernafon AG, Berne (CH)

(72) Inventors: Bernhard Künzle, Berne (CH); Meng Guo, Smørum (DK)

(73) Assignees: OTICON A/S, Smørum (DK); BERNAFON AG, Bern (CH)

( * ) Notice: Subject to any disclaimer, the term of this patent is extended or adjusted under 35 U.S.C. 154(b) by 0 days.

(21) Appl. No.: 15/264,835

(22) Filed: Sep. 14, 2016

(65) Prior Publication Data

US 2017/0078804 A1 Mar. 16, 2017

(30) Foreign Application Priority Data

Sep. 15, 2015 (EP) ..... 15185346

(51) Int. Cl.
*H04R 25/00* (2006.01)

(52) U.S. Cl.
CPC ..... *H04R 25/453* (2013.01); *H04R 25/353* (2013.01)

(58) Field of Classification Search
CPC ..... H04R 25/453; H04R 25/353
USPC ..... 381/318, 71.1, 71.2, 71.8, 71.9, 381/71.11–71.14
See application file for complete search history.

(56) References Cited

U.S. PATENT DOCUMENTS

| | | | | |
|---|---|---|---|---|
| 3,257,510 | A | 6/1966 | Burkhard | |
| 2005/0271222 | A1 | 12/2005 | Freed et al. | |
| 2012/0328118 | A1* | 12/2012 | Pedersen | H04R 25/453 381/71.11 |
| 2014/0146977 | A1* | 5/2014 | Munk | H04R 3/02 381/71.11 |

(Continued)

FOREIGN PATENT DOCUMENTS

| | | | |
|---|---|---|---|
| EP | 1 480 494 | A2 | 11/2004 |
| EP | 1 480 494 | A3 | 4/2006 |
| EP | 2 736 271 | A1 | 5/2014 |

OTHER PUBLICATIONS

Joson et al.,"Adaptive feedback cancellation with frequency compression for hearing aids", The Journal of the Acoustical Society of America, vol. 94,1993, pp. 3248-3254.

*Primary Examiner* — Tuan D Nguyen
(74) *Attorney, Agent, or Firm* — Birch, Stewart, Kolasch & Birch, LLP

(57) ABSTRACT

A hearing device, e.g. a hearing aid, comprises a forward path comprising an input transducer providing an electric input signal, a combination unit, a signal processing unit configured to apply a forward gain to signal of the forward path and to provide a processed electric output signal, a frequency shifting unit for de-correlating the processed electric output signal and the electric input signal, and an output transducer. The hearing device further comprises an adaptive filter for providing an estimate of an external feedback path, and located in the forward path. The feedback estimation unit provides a resulting feedback estimate signal, which is combined with the electric input signal in the combination unit to provide a resulting feedback corrected signal, and a correction unit for influencing said estimate of the feedback path by diminishing a residual bias, being a (Continued)

result of the frequency shift, in said resulting feedback estimate signal.

19 Claims, 5 Drawing Sheets

(56) References Cited

U.S. PATENT DOCUMENTS

| | | | | |
|---|---|---|---|---|
| 2014/0321683 | A1 | 10/2014 | Rosenkranz et al. | |
| 2014/0369537 | A1* | 12/2014 | Pontoppidan ..... | H04R 25/00 381/314 |

* cited by examiner

HEARING DEVICE COMPRISING AN IMPROVED FEEDBACK CANCELLATION SYSTEM

TECHNICAL FIELD

The present application relates to feedback cancellation. The disclosure relates specifically to a hearing device, e.g. a hearing aid, comprising a forward path comprising a frequency shifting unit for de-correlating the processed electric output signal and the electric input signal.

The application furthermore relates to a method of operating a hearing device and to the use of a hearing device. The application further relates to a data processing system comprising a processor and program code means for causing the processor to perform at least some of the steps of the method.

Embodiments of the disclosure may e.g. be useful in applications such as hearing aids, headsets, ear phones, active ear protection systems, handsfree telephone systems, mobile telephones, teleconferencing systems, public address systems, karaoke systems, classroom amplification systems, etc.

BACKGROUND

Acoustic feedback problems occur due to the fact that the output loudspeaker signal of an audio reinforcement system is partly returned to the input microphone via an acoustic coupling through the air. This problem often causes significant performance degradations in applications such as public address systems and hearing aids. In the worst case, the audio system becomes unstable and howling occurs. A state-of-the-art solution for reducing the effects of acoustic feedback is a cancellation system using adaptive filters in a system identification configuration.

Frequency shifting has been used for acoustic feedback control in audio reinforcement systems since 1950s. It can be used as a standalone system and/or it can be combined with an acoustic feedback cancellation system using adaptive filters. A spectral shifting of the loudspeaker signal in an audio system has a de-correlation effect on the reference signal from the error signal, which is useful for alleviating the generally biased adaptive filter estimation. U.S. Pat. No. 3,257,510A deals e.g. with an improved feedback control apparatus. A continuously varying phase shift affording an effective frequency shift between the input and output devices of a public address system or the like is provided, minimizing the tendency of the system to oscillate.

SUMMARY

The present disclosure deals with the effect of de-correlation from the frequency shifting in an acoustic feedback cancellation system. We show that the influence from the frequency shifting, on the correlation function between the reference and error signals, can be divided into two parts: a fast time-varying part and a slowly time-varying part. Especially the slowly time-varying part of the correlation function leads to a periodically time-varying bias in the adaptive filter estimation, which limits the feedback cancellation performance. The disclosure includes a solution to obtain an unbiased estimation by removing the slowly time-varying part in the adaptive filter estimation. As mentioned, it is known that an estimate of a feedback path from output transducer to input transducer of a hearing device (the feedback path being e.g. characterized by its impulse response or frequency response), as e.g. determined by an adaptive filter, has a built-in bias (i.e. the statistical expectation value of the estimated value of the feedback path deviates from a true value of the feedback path by the bias). It is also known, that this bias can be diminished by the introduction of a (small, e.g. 5 Hz-20 Hz) frequency shift in a signal of the forward path. It is the insight of the present inventors, that the frequency shift itself introduces another, though generally smaller, bias (here termed 'residual bias') in the estimate of a feedback path.

An object of the present application is improve feedback cancellation in hearing devices.

Objects of the application are achieved by the invention described in the accompanying claims and as described in the following.

A Hearing Device:

In an aspect of the present application, an object of the application is achieved by a hearing device, e.g. a hearing aid, comprising

- an input transducer for converting an input sound to an electric input signal representing sound,
- an output transducer for converting a processed electric output signal to an output sound or a mechanical vibration,
- a signal processing unit operationally coupled to the input and output transducers and configured to apply a forward gain to the electric input signal or a signal originating therefrom, and
- a frequency shifting unit for de-correlating the processed electric output signal and the electric input signal.

The input transducer, the signal processing unit, the frequency shifting unit, and the output transducer form part of a forward path of the hearing device.

The hearing device further comprises

- a feedback cancellation system for reducing a risk of howl due to acoustic or mechanical feedback of an external feedback path from the output transducer to the input transducer, the feedback cancellation system comprising
  - a feedback estimation unit comprising a first adaptive filter for providing an estimate of said external feedback path, and
  - a combination unit located in the forward path, wherein the feedback estimation unit provides a resulting feedback estimate signal, which is combined with the electric input signal or a signal derived therefrom in the combination unit to provide a resulting feedback corrected signal.

The feedback estimation unit further comprises

- a correction unit for influencing said estimate of the feedback path by diminishing a residual bias in said resulting estimate of the feedback path introduced by the frequency shifting unit.

This has the advantage of improving feedback cancellation, in particular in an acoustic environment comprising tonal components.

In an embodiment, the residual bias is a result of the frequency shift introduced by the frequency shifting unit. In an embodiment, the residual bias follows some properties of the frequency shift introduced by the frequency shifting unit.

The correction unit for compensating said estimate of the feedback path may e.g. be configured to subtract an estimate of the feedback path estimation bias (=the residual bias) introduced by the frequency shifting unit from the (direct, uncompensated) estimated feedback path, to obtain said resulting unbiased (or less biased) estimate of the feedback path.

In an embodiment, the correction unit for influencing said estimate of the feedback path is configured to diminish a residual bias in said resulting estimate of the feedback path introduced by the frequency shifting unit.

In an embodiment, the resulting feedback signal is subtracted from the electric input signal or a signal derived therefrom in the combination unit to provide the resulting feedback corrected signal.

In an embodiment, the correction unit is configured to estimate the residual bias in the estimate of the feedback path as a result of the frequency shift introduced by the frequency shifting unit.

In an embodiment, the correction unit is configured to correct the feedback estimate provided by the adaptive filter to provide the resulting feedback estimate.

In an embodiment, the correction unit is configured to compensate said estimate of the residual bias due to the frequency shift introduced by the frequency shifting unit in said estimate of the feedback path to provide said resulting feedback estimate signal. In an embodiment, the estimate of the residual bias subtracted from an estimate of the feedback path to provide the resulting feedback estimate signal.

In an embodiment, the correction unit is configured to correct said estimate of the feedback path in dependence of one or more dominant frequencies of the electric input signal. In an embodiment, the correction unit is adapted to estimate the residual bias in the estimate of the feedback path due to the frequency shift introduced by the frequency shifting unit in dependence of one or more dominant frequencies of the electric input signal. In an embodiment, the input signal comprises tonal components. In an embodiment, the input signal comprises one or more dominant frequencies. In an embodiment, the input signal comprises at least one pure tone. In an embodiment, the input signal comprises tonal components. In an embodiment, the input signal comprises music.

A biased estimation of the true feedback path h(n) (e.g. its impulse response) at a given point in time (n, n being a time index, e.g. a time frame index) can be expressed as $E[\hat{h}(n)]=h(n)+r_{xu}$, where $E[\hat{h}(n)]$ represents the statistical expectation value of the estimate of the feedback path $\hat{h}(n)$ due to the nonzero correlation $r_{xu}$ between x(n) and u(n), $r_{xu}$ being termed the bias (and the residual bias in case a frequency shift has been introduced), and where x(n) is the incoming signal, and u(n) is the loudspeaker signal (cf. e.g. FIG. 1). In other words, the 'residual bias' is represented by the correlation function x(n)u(n), when applying frequency shifting in the feedback cancellation system. The microphone signal y(n) is a mixture of the incoming signal x(n) and the feedback signal v(n) (cf. e.g. FIG. 1), but in an embodiment of the hearing device, the feedback signals v(n) (cf. e.g. FIG. 1) is ignored since it has no contribution to the estimation of residual bias. Hence, the correlation function x(n)u(n) is approximated by the gradient $g(n)=e(n)e_f(n-d)$ (cf. e.g. FIG. 1 and equation (7)) when minimizing $E[e^2(n)]$ in the adaptive estimation of h(n), where e(n) is the (feedback corrected) error signal, $e_f(n)$ is the modulated error signal (cf. e.g. FIG. 1), and where the introduction of a frequency shift is implemented as a modulation of the error signal e(n) by a frequency $\Delta f=f'$ (e.g. 10 Hz), and parameter d represents a delay of d samples (cf. e.g. FIG. 2, where signal $u(n)e_f(n-d)$).

In an embodiment, the residual bias $r_{xu}$ is approximated by a relatively slowly varying part $\lambda(n)$ of the gradient g(n), wherein the slowly time-varying part follows the modulation frequency $\omega'$, where of $\omega'=2\pi f'$, f' denotes the amount of frequency shift in Hz (cf. e.g. equation (10)).

In an embodiment, the correction unit comprises a second adaptive filter. In an embodiment, the correction unit comprises one or more adaptive filters.

In an embodiment, the correction unit comprises a frequency analysis unit, configured to determine at least one dominant frequency of the input signal. In an embodiment, the frequency analysis unit is adapted to determine one or more ($N_D$) dominant frequencies of the electric input signal (e.g. the $N_D$ most dominating frequencies).

In an embodiment, the hearing device is configured to operate in one or more modes, e.g. a first (e.g. normal) mode and a second (feedback estimation) mode.

In an embodiment, the hearing device is configured to operate in first and second modes, where the correction unit for correcting the estimate of the feedback path is disabled and enabled, respectively.

In an embodiment, the hearing device comprises a hearing aid, a headset, an ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user.

The hearing device comprises an output transducer adapted for providing a stimulus perceived by the user as an acoustic signal based on a processed electric signal. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input transducer for providing an electric input signal representing sound. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises an antenna and transceiver circuitry for wirelessly receiving a direct electric input signal from another device, e.g. a communication device or another hearing device.

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a duration in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a level detector (LD) for determining the level of an input signal (e.g. on a band level and/or of the full (wide band) signal). In a particular embodiment, the hearing device comprises a voice (activity) detector (VAD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector is adapted to detect as a VOICE also the user's own voice. Alternatively, the voice detector is adapted to exclude a user's own voice from the detection of a VOICE. In an embodiment, the hearing device comprises an own voice detector for detecting whether a given input sound (e.g. a voice) originates from the voice of the user of the system.

The hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Various aspects of adaptive filters are e.g. described in [Haykin; 1996].

The feedback suppression system comprises a feedback estimation unit for providing a feedback signal representative of an estimate of the acoustic feedback path, and a combination unit, e.g. a subtraction unit, for subtracting the feedback signal from a signal of the forward path (e.g. as picked up by the input transducer of the hearing device). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$.

The update part of the adaptive filter comprises an adaptive algorithm for calculating updated filter coefficients for being transferred to the variable filter part of the adaptive filter. The adaptation rate of the adaptive algorithm is e.g. determined by a step size (e.g. in an LMS/NLMS algorithm). The timing of calculation and/or transfer of updated filter coefficients from the update part to the variable filter part may be controlled by the activation control unit. The timing of the update (e.g. its specific point in time, and/or its update frequency) may preferably be influenced by various properties of the signal of the forward path. The update control scheme may be supported by one or more detectors of the hearing device.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device is furthermore provided by the present application. The hearing aid comprises an input transducer for converting an input sound to an electric input signal representing sound, and an output transducer for converting a processed electric output signal to an output sound, and a signal processing unit operationally coupled to the input and output transducers and configured to apply a forward gain to the electric input signal or a signal originating therefrom and a frequency shifting unit for de-correlating the processed electric output signal and the electric input signal, the input transducer, the signal processing unit, the frequency shifting unit, and the output transducer forming part of a forward path of the hearing device, the hearing device further comprising a feedback cancellation system for reducing a risk of howl due to acoustic or mechanical feedback of an external feedback path from the output transducer to the input transducer, the feedback cancellation system comprising 1) a feedback estimation unit comprising a first adaptive filter for providing an estimate of said external feedback path, and 2) a combination unit located in the forward path, wherein the feedback estimation unit provides a resulting feedback estimate signal, which is combined with the electric input signal or a signal derived therefrom in the combination unit to provide a resulting feedback corrected signal. The method comprises influencing the resulting estimate of the feedback path by diminishing a residual bias in said resulting estimate of the feedback path, the residual bias resulting from the frequency shift introduced by the frequency shifting unit.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises estimating the residual bias in the estimate of the feedback path due to the frequency shift introduced by the frequency shifting unit.

In an embodiment, the method comprises correcting said estimate of the feedback path in dependence of one or more dominant frequencies of the electric input signal.

In an embodiment, the method comprises adaptively correcting the estimate of the feedback path in dependence of the residual bias. In an embodiment, the method comprises adaptively correcting the estimate of the feedback path in dependence of a signal of the forward path, e.g. the feedback corrected error signal.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 8B shows an embodiment of a feedback enhancement unit (FBE) according to the present disclosure, whereas

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

In the following, column vectors are emphasized using letters in bold; transposition is denoted by the superscript T.

Figure 1:
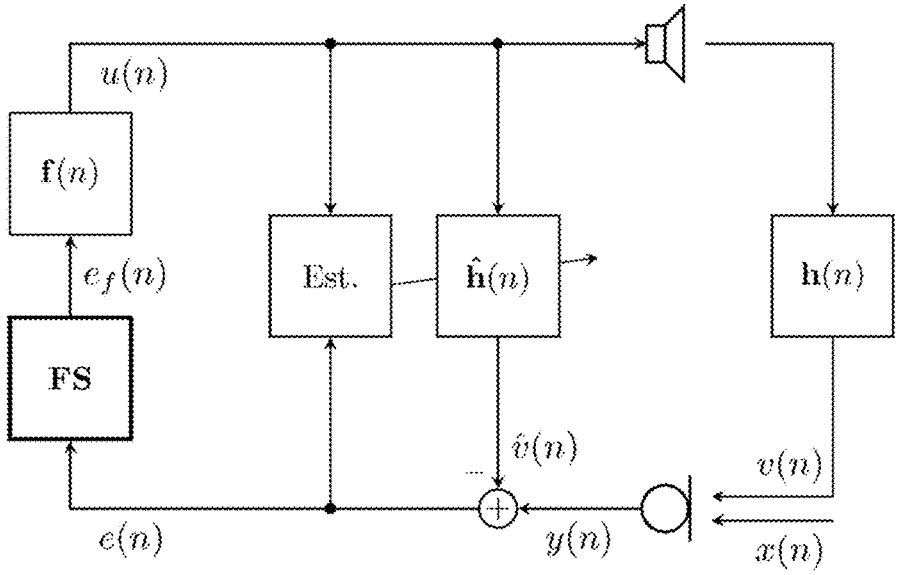
FIG. 1 shows a prior art acoustic feedback cancellation system (AFC) with frequency shifting (FS)

FIG. 1 shows a prior art acoustic feedback cancellation system (AFC) with frequency shifting (FS).

FIG. 1 illustrates a prior art acoustic feedback cancellation (AFC) system using an adaptive filter $\hat{h}(n)$ to model the true acoustic feedback path impulse response h(n), where n is a time index. The incoming signal to the system is denoted by x(n), where the microphone signal y(n) is a mixture of x(n) and the feedback signal v(n). A feedback cancellation signal $\tilde{v}(n)$ is subtracted from y(n) to create the feedback compensated signal e(n). An optional frequency shifting (FS) system is used, and its output signal $e_f(n)$ is modified by the forward signal path f(n) to provide the loudspeaker signal u(n). With an ideal cancellation $\hat{h}(n)=h(n)$, we get e(n)=x(n).

As illustrated in FIG. 1, the adaptive filters in AFC systems generally operate on the signals e(n) and u(n) which can be considered as the input and output of the frequency shifting, by simply assuming f(n)=1. In the case that x(n) is white noise, the correlation between e(n) and u(n) is only caused by the feedback path h(n), and it can be shown that an unbiased estimation of the adaptive filter is possible, i.e., $E[\hat{h}(n)]=h(n)$. On the other hand, when x(n) is a tonal signal, e.g. a pure tone, e(n) and u(n) are always highly correlated, and the adaptive filter estimation would be biased, as $E[\hat{h}(n)]=h(n)+r_{xu}$, where $r_{xu}$ denotes the correlation between x(n) and u(n). When using frequency shifting, the bias contribution r (generally termed the residual bias in the present application) is greatly reduced, and an almost unbiased estimate $\hat{h}(n)$ can be obtained.

However, practical experience by the inventors with frequency shifting in AFC systems has suggested that the estimate $\hat{h}(n)$ still largely suffers from a periodically time-varying (residual) bias, when the incoming signal x(n) is tonal, such as a pure tone or a flute signal. It indicates that there is a signal-dependent residual correlation between x(n) and u(n), even with the frequency shifting.

Figure 2:
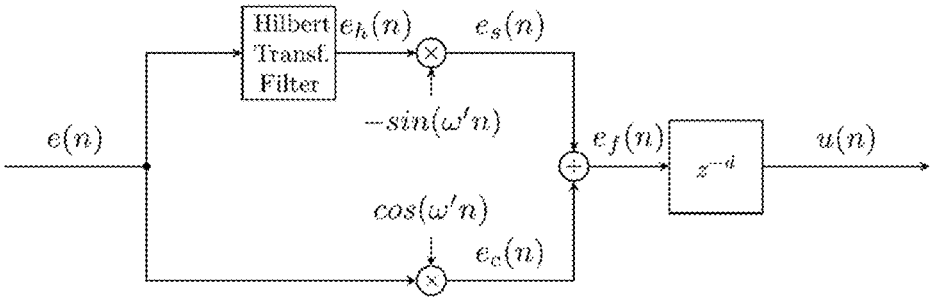
FIG. 2 shows a detailed view of the frequency shifting, where $\omega'$ denotes the amount of frequency shifting, and the forward path $f(n)=\delta(n-d)$.

FIG. 2 shows a detailed view of the frequency shifting, where ω' denotes the amount of frequency shifting, and the forward path f(n)=δ(n−d).

FIG. 2 shows a frequency shifting system carried out as single-sideband modulation and the forward path f(n) is simply modelled by a delay of d samples, as f(n)=δ(n−d). In the following, we express signals $e_h(n)$, $e_s(n)$, $e_c(n)$, $e_f(n)$ and u(n), when the signal e(n), as the input to frequency shifting, is a pure tone with unity amplitude given by $$e(n)=\cos(\omega n+\phi), \tag{1}$$

with the phase φ and the angular frequency $\omega=2\pi(f/f_s)$, where f is the frequency and $f_s$ is the sampling rate in Hz.

The signal $e_h(n)$ after the Hilbert Transform Filter in FIG. 2 is then $$e_h(n)=\cos(\omega n+\phi-\pi/2). \tag{2}$$

The signal $e_s(n)$ after the modulation (in unit 'x' in FIG. 2) by sin(ω'n), where ω' denotes the modulation frequency as $\omega'=2\pi(f'/f_s)$, and f' denotes the amount of frequency shifting in Hz, is expressed by $$e_s(n)=\tfrac{1}{2}\cos((\omega+\omega')n+\phi)-\tfrac{1}{2}\cos((\omega-\omega')n+\phi). \tag{3}$$

The signal $e_c(n)$ after the modulation (in unit 'x' in FIG. 2) by cos(ω'n) is expressed by $$e_c(n)=\tfrac{1}{2}\cos((\omega+\omega')n+\phi)+\tfrac{1}{2}\cos((\omega-\omega')n+\phi). \tag{4}$$

The frequency shifted signal $e_f(n)=e_s(n)+e_c(n)$ (after SUM unit '+' in FIG. 2) is given by $$e_f(n)=\cos((\omega+\omega')n+\phi). \tag{5}$$

When simply modelling the forward path f(n)=δ(n−d) (unit '$z^{-d}$' in FIG. 2), we get $$u(n)=e_f(n-d). \tag{6}$$

It is well-known that a biased estimation of h(n) can occur in an AFC system, i.e., $E[\hat{h}(n)]=h(n)+r_{xu}$, due to the nonzero correlation $r_{xu}$ between x(n) and u(n). In the following, we analyze the correlation function x(n)u(n) when applying frequency shifting in the AFC system.

The feedback signals v(n) and $\tilde{v}(n)$ are ignored in this analysis since they have no contribution to the biased estimation. Hence, the correlation function x(n)u(n) equals to the gradient $g(n)=e(n)e_f(n-d)$ when minimizing $E[e^2(n)]$ in the adaptive estimation of h(n). Moreover, we consider the extreme case when x(n) is a pure tone to clearly demonstrate the effect from frequency shifting on x(n)u(n). Using equations (1) and (5), the gradient $g(n)=e(n)e_1(n-d)$ can be shown to be $$g(n)=\tfrac{1}{2}[\cos((2\omega+\omega')n+2\phi+\theta_1)+\cos(\omega' n+\theta_1)], \tag{7}$$

where $\theta_1=-(\omega+\omega')d$.

We also determine the partial gradients $g_s(n)=e(n)e_s(n-d)$ and $g_c(n)=e(n)e_c(n-d)$, as they make the further analysis more straightforward. Using equations (1), (3) and (4), we obtain $$g_s(n)=(\tfrac{1}{4})[\cos((2\omega+\omega')n+2\phi+\theta_1)+\cos(\omega' n+\theta_1)-\cos((2\omega-\omega')n+2\phi+\theta_2)-\cos(\omega' n-\theta_2)], \tag{8}$$

$$g_c(n)=(\tfrac{1}{4})[\cos((2\omega+\omega')n+2\phi+\theta_1)+\cos(\omega' n+\theta_1)+\cos((2\omega-\omega')n+2\phi+\theta_2)+\cos(\omega' n-\theta_2)], \tag{9}$$

where $\theta_2-(\omega-\omega')d$.

It is interesting to note that all gradients in equations (7)-(9) have two parts, a fast time-varying part with the frequency $2\omega\pm\omega'$ and a slowly time-varying part that follows the modulation frequency $\omega'$.

The adaptive algorithms to estimate h(n) have a low-pass effect, the fast time-varying parts of the gradients have thereby generally no influence on the acoustic feedback path impulse response estimate $\hat{h}(n)$, since the incoming signal frequency is typically from hundreds to thousands of Hz in an audio system.

On the other hand, the slowly time-varying parts have typically a much lower frequency, such as 10-20 Hz, and they would thereby cause a periodic bias in the adaptive estimation of h(n), although to a much lesser degree compared to the adaptive estimation without frequency shifting. More specifically, the slowly time-varying parts of the gradients in equations (7)-(9) can be further expressed by $$\lambda(n)=\tfrac{1}{2}\cos(\omega' n+\theta_1)=\tfrac{1}{2}\cos(\omega'(n-d)-\omega d) \tag{10}$$

$$\begin{aligned}\lambda_s(n) &= \left(\frac{1}{4}\right)\cos(\omega' n+\theta_1)-\left(\frac{1}{4}\right)\cos(\omega' n-\theta_2) \\ &= \frac{1}{2}\sin(\omega d)\sin(\omega'(n-d)),\end{aligned} \tag{11}$$

$$\begin{aligned}\lambda_c(n) &= \left(\frac{1}{4}\right)\cos(\omega' n+\theta_1)+\left(\frac{1}{4}\right)\cos(\omega' n-\theta_2) \\ &= \frac{1}{2}\cos(\omega d)\cos(\omega'(n-d)),\end{aligned} \tag{12}$$

In the following, we discuss how to reduce the influence from equations (10)-(12) on the feedback path estimate $\hat{h}(n)$. In principle, one could use a larger amount of frequency shifting so that the periodic functions in equations (10)-(12) had a higher modulation frequency $\omega'$ and would thereby have less impact on the adaptive estimation with an averaging effect. Similarly, one could use a smaller step size in the adaptive estimation to increase its averaging effect, which reduces the effect from the periodic (residual) bias. However, larger amount of frequency shifting degrades sound quality and smaller step size reduces the convergence and tracking abilities in AFC systems, and both should be avoided. Hence, we need more sophisticated methods to handle the periodic (residual) bias.

We observe that $\lambda(n)$, $\lambda_s(n)$, and $\lambda_c(n)$ in equations (10)-(12) are functions of only a few parameters, the modulation frequency $\omega'$, the delay d, and the incoming signal frequency co. In contrast to $\omega'$ and d, the incoming signal frequency $\omega$ is unknown from the point of view of the audio system. It means that the phase $-\omega d$ of equation (10), the amplitude parts $\sin(\omega d)$ and $\cos(\omega d)$ of equations (11) and (12) are unknown. Hence, equations (10)-(12) are somewhat challenging to estimate due to the unknown and time-varying incoming signal frequency co. Nevertheless, in the case we make a direct correction on g(n) in equation (7), we would need to estimate the phase $-\omega d$ of $\lambda(n)$ in equation (10); when we make an indirect correction on $g_s(n)$ and $g_c(n)$ in equations (8) and (9), we need to estimate the amplitudes $\sin(\omega d)$ and $\cos(\omega d)$ in equations (11) and (12).

Moreover, when x(n) is a complex signal with multiple frequencies, the slowly time-varying parts contributed by each frequency $\omega$ follow equations (11)-(12). They have different amplitudes $\sin(\omega d)$ and $\cos(\omega d)$, but identical modulation frequency $\omega'$ and phase $-\omega' d$. More interestingly, the sums of the amplitudes $\Sigma_\omega \sin(\omega d)$ and $\Sigma_\omega \cos(\omega d)$ approach zero as the number of frequencies increases. In other words, the slowly time-varying parts, contributed by multiple frequencies, cancel each other. This explains why we mainly experience periodic (residual) bias in $\hat{h}(n)$ with tonal incoming signals x(n).

In the following, an embodiment of a correction method to remove the periodic (residual) bias from $\hat{h}(n)$ is described. In this embodiment, the correction method uses a simple NLMS update algorithm for the adaptive filter $\hat{h}(n)$ of order L−1.

Figure 3:
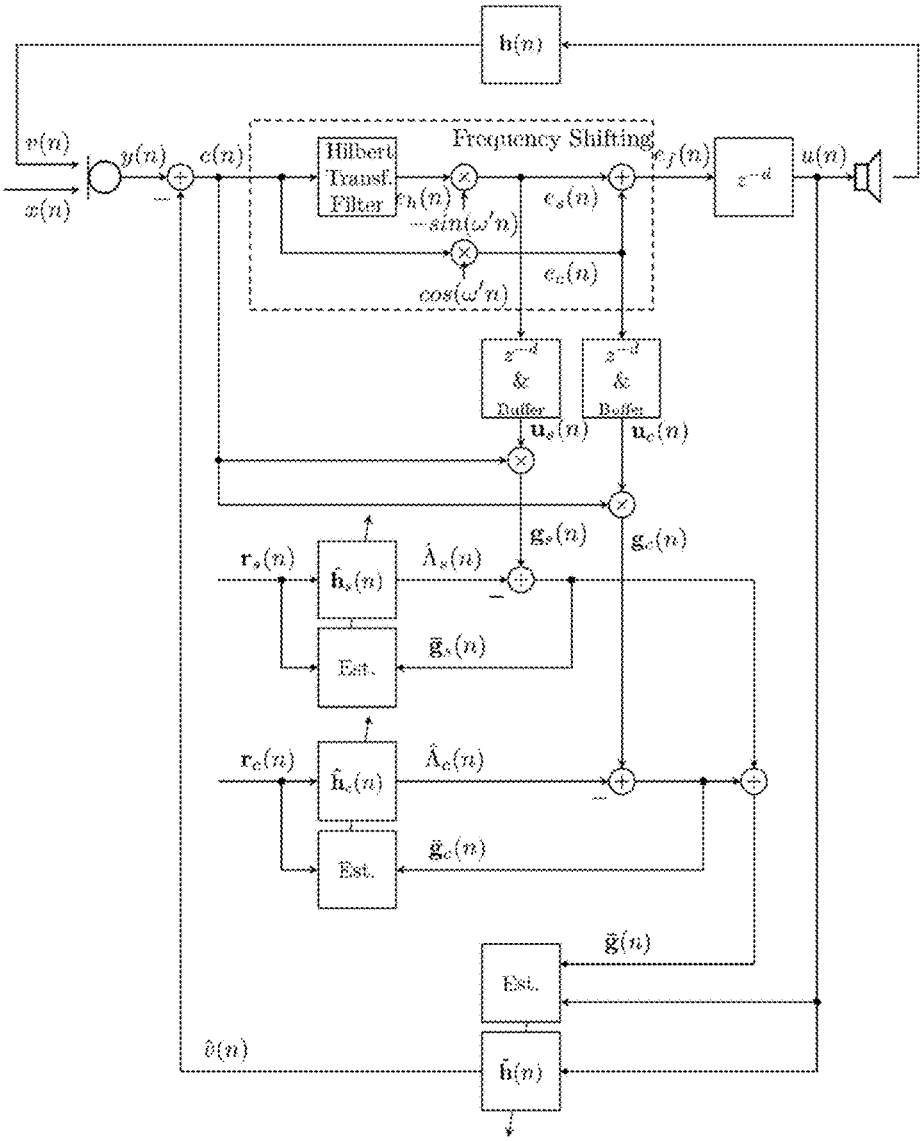
FIG. 3 shows a block diagram of an embodiment of an acoustic feedback cancellation system with gradient correction according to the present disclosure.

FIG. 3 shows a block diagram of an embodiment of an acoustic feedback cancellation system with gradient correction according to the present disclosure.

FIG. 3 shows an estimation setup of h(n) with the corrected gradient g(n) using correction coefficients $\hat{h}_s(n)$ and $\hat{h}_c(n)$. The idea is to subtract the slowly time-varying estimates $\Lambda_{est,s}(n)$ and $\Lambda_{est,s}(n)$ from the partial gradients $g_s(n)$ and $g_c(n)$, respectively, to prevent (residual) bias in $\hat{h}(n)$. The forward path f(n) is again simply modelled by $\delta(n-d)$.

In the following, the correction setup is described with reference to FIG. 3. The partial frequency shifted signals $e_m(n)$, where m represents either s or c, are delayed by d samples and buffered into the partial reference vectors $u_m(n)=[u_m(n), \ldots, u_m(n-L+1)]^T$, as $$u_m(n)=[e_m(n-d), \ldots, e_m(n-d-L+1)]^T. \tag{13}$$

The partial gradients $g_m(n)$ are given by $$g_m(n)=e(n)u_m(n). \tag{14}$$

The reference correction signals $r_m(n)=[r_m(n), \ldots, r_m(n-L+1)]^T$ are $$r_s(n)=\tfrac{1}{2}[\sin(\omega'(n-d), \ldots, \sin(\omega'(n-d-L+1))]^T, \tag{15}$$

$$r_c(n)=\tfrac{1}{2}[\cos(\omega'(n-d), \ldots, \cos(\omega'(n-d-L+1))]^T. \tag{16}$$

Therefore, equations (15) and (16) contain the known parts of equations (11) and (12), which are independent of the incoming signal x(n). On the other hand, the correction coefficient estimates $\hat{h}_m(n)=[\hat{h}_m^{\,0}(n), \ldots, \hat{h}_m^{\,L-1}(n)]^T$ of order L−1 should ideally contain the unknown amplitude parts in equations (11) and (12), as $$\hat{h}_s(n)=[\sin(\omega d), \ldots, \sin(\omega(d-L+1))]^T, \tag{17}$$

$$\hat{h}_c(n)=[\cos(\omega d), \ldots, \cos(\omega(d-L+1))]^T, \tag{18}$$

In equation (21) below, it is shown how to estimate the coefficients $\hat{h}_m(n)$ in equation (17) and (18). Furthermore, $\Lambda_{est,m}(n)=[\lambda_{est,m}^{\,0}(n), \ldots, \lambda_{est,m}^{\,L-1}(n)]^T$ of the estimates of the slowly time-varying parts, and the $i^{th}$ element is $$\lambda_{est,m}^{\,i}(n),=r_m(n-i)\hat{h}_m^{\,i}(n). \tag{19}$$

The corrected partial gradient $\bar{g}_m(n)=[\bar{g}_m^{\,0}(n), \ldots, \bar{g}_m^{\,L-1}(n)]^T$ is computed as $$\bar{g}_m(n)=g_m(n)-\Lambda_{est,m}(n). \tag{20}$$

The correction coefficients $\hat{h}_m(n)$ are adaptively estimated using a simple LMS/NLMS algorithm. The $i^{th}$ element $\hat{h}_m^{\,i}(n)$ is updated with respect to minimize $|\bar{g}_m^{\,i}(n)|^2$, i.e., the mean square error of the $i^{th}$ element in $\bar{g}_m(n)$, as $$\hat{h}_m^{\,i}(n+1)=\hat{h}_m^{\,i}(n)+\mu_c\bar{g}_m^{\,i}(n)r_m(n-1), \tag{21}$$

where $\mu_c$ is the step size parameter of the NLMS algorithm that controls the adaptation rate.

Finally, the NLMS update of $\hat{h}(n)$ is carried out by using the corrected gradient $\bar{g}(n)=\bar{g}_s(n)+\bar{g}_c(n)$, with $\mu$ and $\delta$ as the step size and regularization parameters for the NLMS algorithm, as $$\hat{h}(n+1) = \hat{h}(n) + \mu \frac{\bar{g}(n)}{\|u(n)\|^2 + \delta}. \quad (22)$$

Two additional correction coefficients $\hat{h}_s^i(n)$ and $\hat{h}_c^i(n)$ are used to correct each gradient element $\bar{g}(n)=\bar{g}_s^i(n)+\bar{g}_c^i(n)$. The additional adaptive estimations in equation (21) are based on the reference correction signals $r_m(n)$ in equations (15) and (16). They are defined by the known basis sine and cosine functions with the modulation frequency ω' and the delay d. Hence, $r_m(n)$ is independent of the incoming signal x(n) which is a very desirable property.

Ideally, the corrected gradients g(n) do not contain the slowly time-varying functions in equations (10)-(12), and the estimation in equation (22) is unaffected by the periodic (residual) bias. Should x(n) be a pure tone signal with the frequency ω, the gradients $g_m(n)$ contain both the frequency components 2ω±ω' and ω' as shown in equations (8) and (9), but only the low frequency component ω' have an influence on the estimates $\hat{h}_m(n)$, which would be the terms stated in equations (17) and (18), i.e., the unknown amplitude parts in equations (11) and (12).

Moreover, the correction coefficients will only remove the slowly time-varying functions in equations (11)-(12) when x(n) is tonal, and they have no impact on the estimate $\hat{h}(n)$ when x(n) does not correlate with u(n). In other words, if x(n) was a white noise signal, there is no correlation between x(n) and u(n), and the estimates $E[\hat{h}_m(n)]=0$. This will be evident from the following simulation results, which demonstrate that the gradient correction method presented above can highly reduce the residual bias in $\hat{h}(n)$, which has the advantage of allowing a larger amplification in the forward path f(n).

A delay d=120 samples and a gain of 40 dB is used to model the forward path f(n). A sampling rate of 20 kHz, and a frequency shifting of f'=10 Hz are chosen, so that ω'=π/1000 (normalized with the sampling frequency). Furthermore, we use $\mu_c=2^{-8}$, $\mu=2^{-6}$, $\delta=2^{-14}$, and L=64 in the adaptive estimations of $\hat{h}_m(n)$ and $\hat{h}(n)$. Moreover, we use a measured hearing aid feedback path h(n), as shown in FIG. 4.

Figure 4:
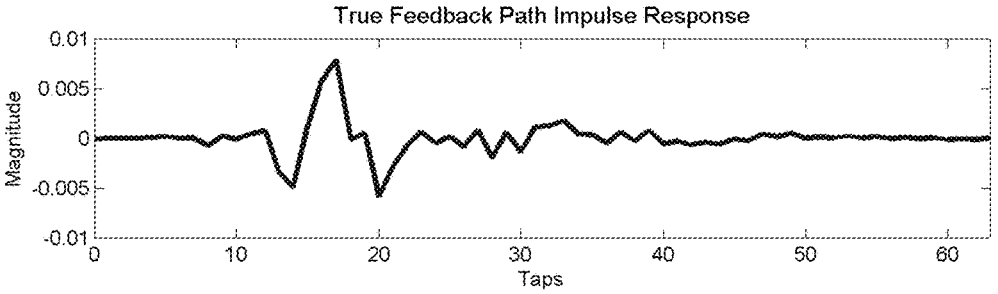
FIG. 4 shows an exemplary true feedback path (impulse response) h(n) from a hearing aid system.

FIG. 4 shows an exemplary true feedback path (impulse response) h(n) from a hearing aid system.

We choose three different incoming signals x(n), each to be a concatenation of 2 s of white noise and 6 s of a pure tone signal at either 2, 3, or 4 kHz. We use different pure tones to show that the values of $\hat{h}_m(n)$ depend on the incoming signal frequency ω and we are able to estimate them. We use the white noise signal to show that the gradient correction method is transparent when the incoming signal x(n) is not tonal, i.e., $\hat{h}_m(n)=0$.

Figure 5:
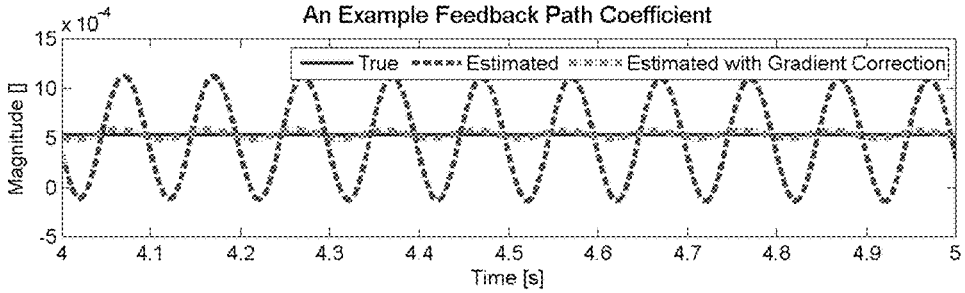
FIG. 5 shows a biased coefficient estimation (dashed line), in an acoustic feedback cancellation system with a frequency shifting of 10 Hz, and a significantly reduced bias (dash-dotted line) when using the gradient correction.

FIG. 5 shows a biased coefficient estimation (dashed line), in an acoustic feedback cancellation system with a frequency shifting of 10 Hz, and a significantly reduced (residual) bias (dash-dotted line) when using the gradient correction.

FIG. 5 illustrates an example feedback path coefficient (tap i=19 in FIG. 4) when x(n) is a 2 kHz tone, we observe that the true coefficient $h=5.26\times10^{-4}$, whereas the estimate without correction $\hat{h}(n)\in[-1.41, 11.19]\times10^{-4}$ suffers largely from a periodic (residual) bias of 10 Hz, and the relative deviation of h(n) is thereby up to 126.8%. On the other hand, although there is still a small remaining periodic (residual) bias when using the gradient correction, where $\hat{h}(n)\in[4.93, 5.67]\times10^{-4}$, the relative deviation is largely reduced to less than 8%.

Figure 6:
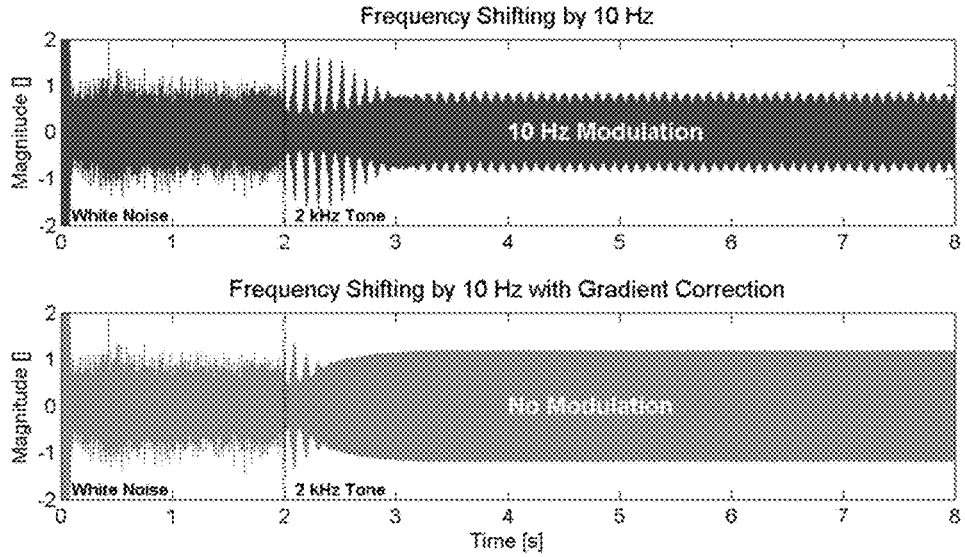
FIG. 6 shows two examples of output signals without and with the gradient correction according to the present disclosure.

FIG. 6 shows two examples of output signals without and with the gradient correction according to the present disclosure.

FIG. 6 shows the output signals u(n) without and with the gradient correction. In the white noise sections, $\hat{h}(n)$ converges and nothing remarkable is observed. However, without the gradient correction, there is a clearly noticeable modulation of 10 Hz in the pure tone section. Moreover, when applying the gradient correction, there is a run-in period of approximately 1.5 seconds whereafter the modulation of 10 Hz is removed from the pure tone signal. The run-in period relates to the convergence of the correction coefficients $\hat{h}_m(n)$. There is a compromise between the duration of the run-in period (convergence) and the accuracy (steady-state) of the correction coefficients. In general, a shorter duration leads to less accurate correction coefficients and vice versa. This is the consequence of using additional adaptive filters to estimate the correction coefficients.

Figure 7:
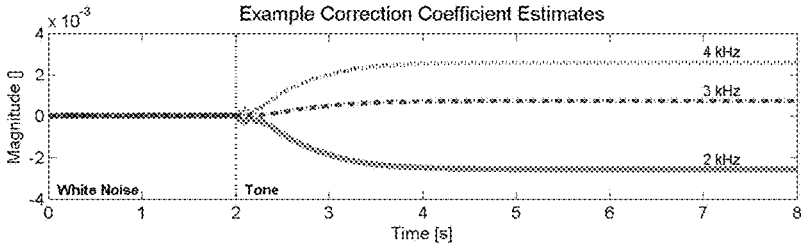
FIG. 7 shows correction coefficient values follow the incoming signal.

FIG. 7 shows correction coefficient values (Magnitude, numerical value as indicated by an empty unit bracket [ ], versus Time [s]) following the incoming signal. When the incoming signal is white noise, the correction coefficients should have no effect as they are zero as shown in the first (left-hand) part of the graph between Time=0 and Time=2 s. On the other extreme, for pure tones the correction coefficients should be nonzero, and the value depends on the incoming signal frequency as illustrated for pure tone frequencies 2 kHz, 3 kHz and 4 kHz the second (right-hand) part of the graph between Time=2 s and Time=8 s. As illustrated in FIG. 7, there is an initial asymptotic transient course of the graph after the transition from an input signal dominated by white noise to an input signal comprising pure tones (cf. course of the graphs between Time=2 s and Time 3.5 s). In the exemplary illustration, the magnitude of the correction values varies between 0 and approximately 3 (4 kHz graph) or −3 (2 kHz graph) from the white noise to the pure tone input signal.

FIG. 7 shows the correction coefficients $\hat{h}_s(n)$ with all three pure tone signals (2 kHz, 3 kHz and 4 kHz). As expected we obtained $\hat{h}_s(n)\approx0$ during the white noise section. For the pure tones at 2, 3, and 4 kHz, the steady-state estimates of $\hat{h}_s(n)$ are different, and there is a convergence period of approximately 1.5 s, which explains the run-in period in FIG. 6.

Figure 8A:
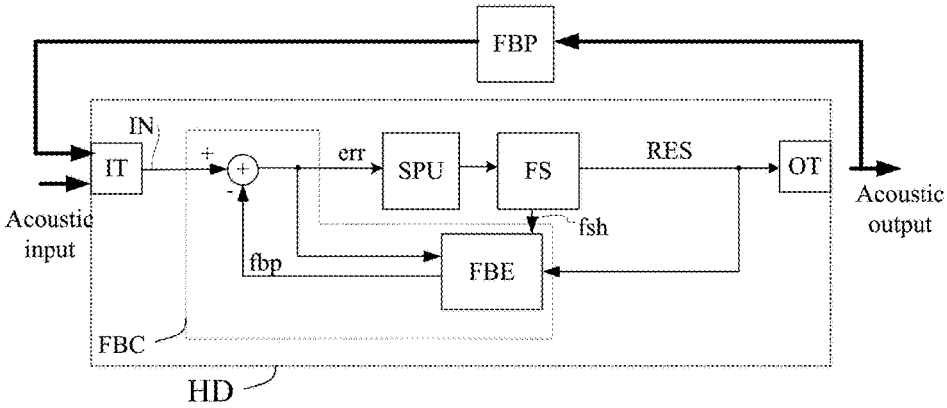
FIG. 8A shows an embodiment of a hearing device according to the present disclosure.
Figure 8B:
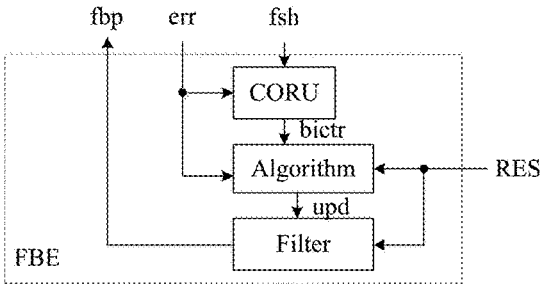

FIG. 8A shows an embodiment of a hearing device according to the present disclosure. FIG. 8A illustrates a hearing device (HD), e.g. a hearing aid, comprising a forward path comprising a) an input transducer (IT) for converting an input sound to an electric input signal IN representing sound, b) an output transducer (OT) for converting a processed electric output signal RES to an output sound, c) a signal processing unit (SPU) operationally coupled to the input and output transducers and configured to apply a forward gain to the electric input signal IN or a signal originating therefrom, and d) a frequency shifting unit (FS) for de-correlating the processed electric output signal RES and the electric input signal IN. The hearing device (HD) further comprises a feedback cancellation system (FBC) for reducing a risk of howl due to acoustic or mechanical feedback of an external feedback path (FBP) from the output transducer (OT) to the input transducer (IT). The feedback cancellation system comprises a feedback estimation unit (FBE) comprising a first adaptive filter (Algorithm, Filter, see FIG. 8B) for providing an estimate fbp of said external feedback path, and a combination unit ('+') located in the forward path. The feedback estimation unit (FBE) provides a resulting feedback estimate signal fbp, which is combined with the electric input signal IN or a signal derived therefrom in the combination unit ('+') to provide a resulting feedback corrected signal err. As illustrated in FIG. 8B, the feedback estimation unit (FBE) comprises a first adaptive filter (Algorithm, Filter) providing the resulting estimate of the external feedback path (FBP) based on the feedback corrected error signal err, the processed output signal RES and a control signal bictr indicative of the residual bias. The feedback estimation unit (FBE) further comprises a correction unit (CORU) for influencing the resulting estimate fbp of the feedback path (FBP) by taking into account (diminishing) a residual bias in the feedback estimate as a result of the frequency shift ω' introduced by the frequency shifting unit (FS). The correction unit (CORU) receives a signal fsh from the frequency shifting unit FS indicative of the frequency shift ω'. Based thereon, and on a signal of the forward path indicative of the frequency content of the external signal (e.g., as shown in FIG. 8B, the feedback corrected signal err), the correction unit (CORU) is adapted to minimize the residual bias in the estimate of the feedback path in dependence of one or more dominant frequencies $\omega_p$ of the electric input signal IN or the feedback corrected signal err. In an embodiment, the correction unit (CORU) comprises a frequency analysis unit (FAU), configured to determine at least one dominant frequency of the input signal IN (or a signal derived therefrom, e.g. err). In an embodiment, the frequency analysis unit (FAU) is adapted to determine two or more ($N_D$) dominant frequencies of the electric input signal IN (e.g. the $N_D$ most dominating frequencies) (or a signal derived therefrom). Preferably, the correction unit (CORU) comprises one or more (e.g. a second and third) adaptive filter (in addition to the (first) adaptive filter providing the resulting estimate fbp of the external feedback path (FBP) in FIG. 8. For an embodiment thereof, see e.g. FIG. 3.

Figure 8C:
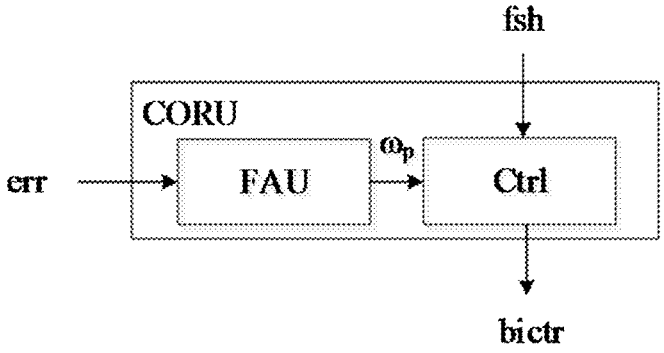
FIGS. 8C and 8D show respective first and second embodiments of a correction unit (CORU) of an embodiment of an enhancement unit according to the present disclosure, the correction unit being adapted for influencing the resulting estimate fbp of the feedback path (FBP) via control signal bictr indicative of the residual bias.
Figure 8D:
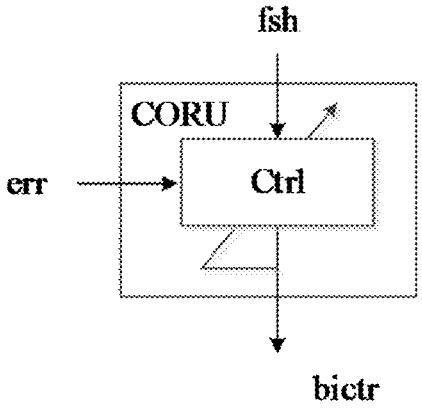

FIGS. 8C and 8D show respective first and second embodiments of a correction unit (CORU) of an embodiment of an enhancement unit according to the present disclosure, the correction unit being adapted for influencing the resulting estimate fbp of the feedback path (FBP) via control signal bictr indicative of the residual bias.

FIG. 8C shows illustrates the estimation by a frequency analysis unit (FAU) of the dominant frequencies $\omega_p$ of the error signal err (or another signal of the forward path, such as the electric input signal IN). The estimated dominant frequencies $\omega_p$ (p=1, 2, . . . , $N_D$, where $N_D$ is the number of dominant frequencies, e.g. having a level above a certain threshold $L_{D,th}$) and the control signal fsh indicative of the frequency shift ω' (from the frequency shift unit (FS)) are used to generate the bias control signal bictr in the control block (Ctrl).

FIG. 8D shows another embodiment of the correction unit (CORU). The control unit (Ctr) is configured to adaptively determine the bias control signal bictr from error signal err. In an embodiment, the control unit comprises one or more additional adaptive filter to generate the bias control signal bictr. An embodiment of this is shown in FIG. 3.

In conclusion the present disclosure shows that adaptive filters can suffer from a residual bias when using a small amount of frequency shifting, such as 10-20 Hz, in acoustic feedback cancellation systems. This (residual) bias is periodic and its frequency is identical to the amount of frequency shifting. According to the present disclosure, a correction method to remove the residual bias contribution from the gradients to the adaptive filter estimation is proposed. Simulation results have demonstrated that this method is effective to reduce the relative deviation of an example adaptive filter coefficient from more than 126% to less than 8% for the most critical pure tone signals. The exemplary embodiments of a hearing device according to the present disclosure discussed above (e.g. the feedback cancellation system) may be implemented in the time domain, but may as well be implemented in the time-frequency domain or partly in the time domain and partly in the time-frequency domain. Specifically, with reference to the equation numbers above, equation (10) states explicitly the residual bias in the feedback path estimate due to the introduction of frequency shift, for a particular incoming signal frequency ω. For convenience, we divide equations (10) to (11) and (12) as partial residual bias, i.e., adding equations (11) and (12) we get (10). Part of equations (11) and (12) are known, given by equations (15) and (16), and we estimate the unknown parts as given in equations (17) and (18) with the middle part in FIG. 3 (comprising the two adaptive filters receiving as inputs signals $r_s(n)$ and $r_c(n)$).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

U.S. Pat. No. 3,257,510A (INDUSTRIAL RESEARCH PRODUCTS, INC) 21 Jun. 1966

[Schaub; 2008] Arthur Schaub, Digital hearing Aids, Thieme Medical. Pub., 2008.

[Haykin, 1996] Simon Haykin, Adaptive Filter Theory, Prentice Hall, 3rd edition, 1996, ISBN 0-13-322760-X.

The invention claimed is:

1. A hearing device, e.g. a hearing aid, comprising an input transducer for converting an input sound to an electric input signal representing sound, an output transducer for converting a processed electric output signal to an output sound or mechanical vibration, a signal processing unit operationally coupled to the input and output transducers and configured to apply a forward gain to the electric input signal or a signal originating therefrom, and a frequency shifting unit for de-correlating the processed electric output signal and the electric input signal, the input transducer, the signal processing unit, the frequency shifting unit, and the output transducer forming part of a forward path of the hearing device, the hearing device further comprising a feedback cancellation system for reducing a risk of howl due to acoustic or mechanical feedback of an external feedback path from the output transducer to the input transducer, the feedback cancellation system comprising a feedback estimation unit comprising a first adaptive filter for providing an estimate of said external feedback path, and a combination unit located in the forward path, wherein the feedback estimation unit provides a resulting feedback estimate signal, which is combined with the electric input signal or a signal derived therefrom in the combination unit to provide a resulting feedback corrected signal, wherein the feedback estimation unit further comprises a correction unit for compensating said estimate of the feedback path by diminishing a residual bias in said resulting estimate of the feedback path introduced by the frequency shifting unit, wherein said residual bias is defined as a difference between a statistical estimation of the feedback path and the true feedback path as a result of a frequency shift introduced by the frequency shifting unit, and wherein said residual bias is represented by the correlation function between the electric input signal and the processed output signal.

2. A hearing device according to claim 1 wherein the correction unit is configured to estimate the residual bias in the estimate of the feedback path as a result of the frequency shift introduced by the frequency shifting unit.

3. A hearing device according to claim 1 wherein the correction unit is configured to correct the feedback estimate provided by the adaptive filter to provide the resulting feedback estimate.

4. A hearing device according to claim 2 wherein the correction unit is configured to compensate said estimate of the residual bias due to the frequency shift introduced by the frequency shifting unit in said estimate of the feedback path to provide said resulting feedback estimate signal.

5. A hearing device according to claim 1 wherein the correction unit is configured to correct said estimate of the feedback path in dependence of one or more dominant frequencies of the electric input signal.

6. A hearing device according to claim 1 wherein the correction unit comprises a second adaptive filter.

7. A hearing device according to claim 1 wherein the correction unit comprises a frequency analysis unit, configured to determine at least one dominant frequency of the input signal.

8. A hearing device according to claim 1 configured to operate in first and second modes, where said correction unit for correcting the estimate of the feedback path is disabled and enabled, respectively.

9. A hearing device according to claim 1 wherein the residual bias is represented by the correlation $r_{xu}$ between x(n) and u(n), where x(n) is the incoming signal, and u(n) is the loudspeaker signal, and n is a time index.

10. A hearing device according to claim 1 wherein the residual bias is approximated by the gradient $g(n)=e(n)e_f(n-d)$ when minimizing $E[e^2(n)]$ in the adaptive estimation of the true feedback path b(n), where E[•] is the statistical expectation operator, e(n) is the (feedback corrected) error signal, $e_f(n)$ is the modulated error signal, when modulated by a frequency shift $\Delta f=f'$, and parameter d represents a delay of d samples, and n is a time index.

11. A hearing device according to claim 10 wherein the residual bias $r_{xu}$ is approximated by a relatively slowly time varying part $\lambda(n)$ of the gradient g(n), wherein the slowly time-varying part follows the modulation frequency $\omega'$, where $\omega'=2\pi f'$, f' denotes the amount of frequency shift in Hz, and n is a time index.

12. A hearing device according to claim 1 comprising a hearing aid, a headset, an ear protection device or a combination thereof.

13. Use of a hearing device as claimed in claim 1.

14. A method of operating a hearing device comprising an input transducer for converting an input sound to an electric input signal representing sound, and an output transducer for converting a processed electric output signal to an output sound, and a signal processing unit operationally coupled to the input and output transducers and configured to apply a forward gain to the electric input signal or a signal originating therefrom and a frequency shifting unit for de-correlating the processed electric output signal and the electric input signal, the input transducer, the signal processing unit, the frequency shifting unit, and the output transducer forming part of a forward path of the hearing device, the hearing device further comprising a feedback cancellation system for reducing a risk of howl due to acoustic or mechanical feedback of an external feedback path from the output transducer to the input transducer, the feedback cancellation system comprising 1) a feedback estimation unit comprising a first adaptive filter for providing an estimate of said external feedback path, and 2) a combination unit located in the forward path, wherein the feedback estimation unit provides a resulting feedback estimate signal, which is combined with the electric input signal or a signal derived therefrom in the combination unit to provide a resulting feedback corrected signal, the method comprising compensating the resulting estimate of the feedback path by diminishing a residual bias in said resulting estimate of the feedback path, the residual bias resulting from the frequency shift introduced by the frequency shifting unit, wherein said residual bias is defined as a difference between a statistical estimation of the feedback path and the true feedback path as a result of a frequency shift introduced by the frequency shifting unit, and wherein said residual bias is represented by the correlation function between the electric input signal and the processed output signal.

15. A method according to claim 14 comprising estimating the residual bias in the estimate of the feedback path due to the frequency shift introduced by the frequency shifting unit.

16. A method according to claim 15 comprising correcting said estimate of the feedback path in dependence of one or more dominant frequencies of the electric input signal.

17. A method according to claim 14 comprising adaptively correcting said estimate of the feedback path in dependence of said residual bias.

18. A method according to claim 14 wherein the residual bias is approximated by the gradient $g(n)=e(n)e_f(n-d)$ when minimizing $E[e^2(n)]$ in the adaptive estimation of the true feedback path $h(n)$, where $E[\bullet]$ is the statistical expectation operator, $e(n)$ is the (feedback corrected) error signal, $e_f(n)$ is the modulated error signal, when modulated by a frequency shift $\Delta f=f'$, and parameter d represents a delay of d samples, and n is a time index.

19. A data processing system comprising a processor and program code means for causing the processor to perform the steps of the method claim 14.

* * * * *